US005617647A

United States Patent [19]

Okane et al.

[11] Patent Number: 5,617,647

[45] Date of Patent: Apr. 8, 1997

[54] COMPONENT DRIER

[75] Inventors: Masaaki Okane; Masataka Mae, both of Kyoto, Japan

[73] Assignee: Murata Manufacturing Co., Ltd., Japan

[21] Appl. No.: 527,104

[22] Filed: Sep. 12, 1995

Related U.S. Application Data

[63] Continuation of Ser. No. 802,360, Dec. 4, 1991.

[30] Foreign Application Priority Data

Dec. 4, 1990 [JP] Japan ..... 2-400398

[51] Int. Cl.[6] ..... F26B 17/00

[52] U.S. Cl. ..... 34/218; 34/219; 34/233; 34/227; 34/77

[58] Field of Search ..... 34/218, 219, 223, 34/225, 227, 233, 57 A, 22, 34, 73, 74, 75, 76, 77, 196, 197

[56] References Cited

U.S. PATENT DOCUMENTS

| | | | |
|---|---|---|---|
| 1,422,620 | 7/1922 | Power | 34/197 X |
| 4,361,967 | 12/1982 | Bahnsen et al. | 34/20 |
| 4,447,965 | 5/1984 | Bray | 34/76 |
| 4,761,896 | 8/1988 | Miyata | 34/77 |
| 4,951,401 | 8/1990 | Suzuki et al. | 34/77 |
| 5,048,201 | 9/1991 | Layton | 34/77 |

FOREIGN PATENT DOCUMENTS

| | | | |
|---|---|---|---|
| 1302183 | 7/1962 | France . | |
| 1871587 | 11/1962 | Germany . | |
| 2936769 | 9/1979 | Germany . | |
| 4002699 | 1/1989 | Japan | 34/202 |

*Primary Examiner*—Henry A. Bennett
*Assistant Examiner*—Dinnatia Doster
*Attorney, Agent, or Firm*—Ostrolenk, Faber, Gerb & Soffen, LLP

[57] ABSTRACT

In order to uniformly dry a large number of electronic components such as multilayer capacitors with high thermal efficiency in a short time, a vat, whose bottom wall is formed by a net, receives a plurality of electronic components. In a closed housing, hot air which is heated by a heater is forced to pass through the plurality of electronic components and the bottom wall of the vat by attraction by an air attracter.

5 Claims, 2 Drawing Sheets

COMPONENT DRIER

This is a continuation of Application Ser. No. 07/802,360 filed on Dec. 4, 1991.

BACKGROUND OF THE INVENTION

1. Field of the Invention

The present invention relates to a component drier which is employed for drying components such as electronic components, and more particularly, it relates to a component drier using hot air.

2. Description of the Background Art

FIG. 3 shows a conventional component drier 1 using hot air for drying electronic components such as multilayer capacitors, for example.

Referring to FIG. 3, the component drier 1 comprises a housing 2, a rack 3 which is arranged in the housing 2, and a vat 5 which is provided on the rack 3 for receiving a plurality of components 4 to be dried. A heater 6 is arranged in the housing 2 for generating hot air, which is fed into the housing 2 by a fan 7 as shown by arrows. The housing 2 is provided with an openable damper 8, for discharging wet air.

The hot air is supplied to the components 4, which are received in the vat 5, along the arrows. The components 4 in the lower part of the vat 5 take longer to dry than those provided in a relatively upper portion of the vat 5.

In the component drier 1 shown in FIG. 3, however, it takes much time to dry the components 4 which are around the bottom surface of the vat 5, since the components 4 are dried after those in a relatively upper portion.

Further, the hot air, which is merely supplied rather indirectly to the set of the components 4, has low thermal efficiency and consumes relatively high energy for drying the components 4.

SUMMARY OF THE INVENTION

Accordingly, an object of the present invention is to provide a component drier which can dry all of a plurality of components with high thermal efficiency in a short time.

The component drier according to the present invention comprises a vat for receiving a plurality of components to be dried. At least the bottom wall of the vat is adapted to allow passage of air. The component drier further comprises means for supplying hot air for drying the components, and means for forcing the hot air to pass through the plurality of components and the bottom wall of the vat which operates on the basis of attraction (suction).

According to the present invention, the hot air-is forced to pass through the plurality of components to be dried on the basis of attraction. Thus, it is possible to uniformly supply the hot air to all of the components which are received in the vat at any level.

According to the present invention, therefore, it is possible to improve the thermal efficiency for drying the components and to reduce the time for such drying, thereby reducing the energy which is required for drying the components.

Thus, the components can be dried in a short time with hot air of a low temperature, whereby the component drier causes no oxidation of electrodes, which are provided in electronic components, for example. Consequently, it is possible to maintain such electrodes of the electronic components in excellent solderability.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
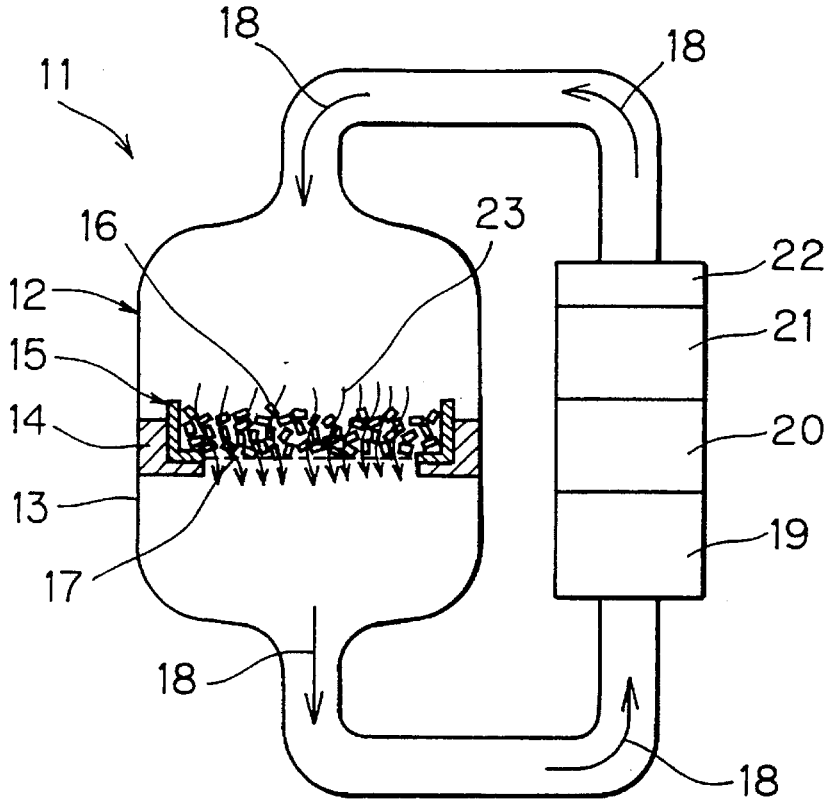
FIG. 1 is an illustrative sectional view showing a component drier 11 according to an embodiment of the present invention.
Figure 2:
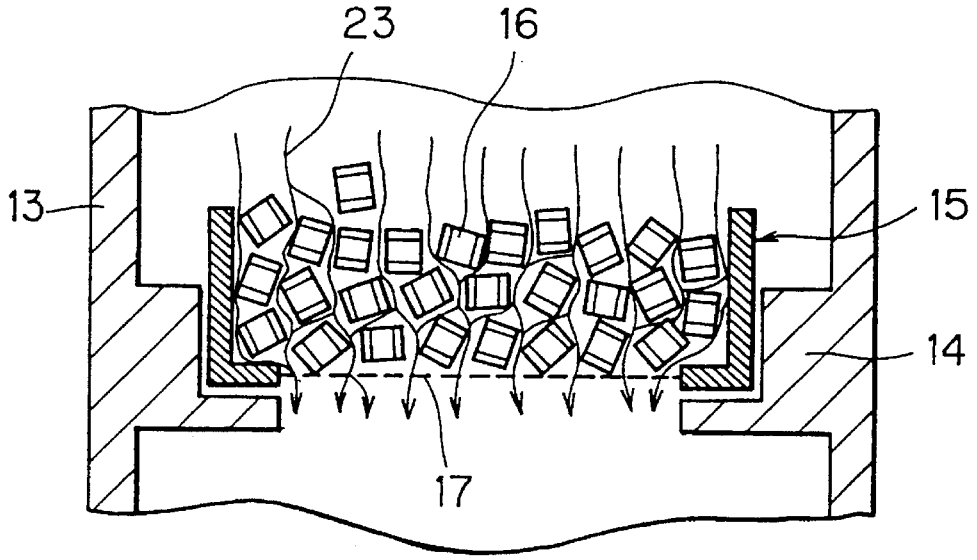
FIG. 2 is an enlarged sectional view showing a drying station 13 of the component drier 11 shown in FIG. 1.

FIG. 1 is an illustrative sectional view showing a component drier 11 according to an embodiment of the present invention. FIG. 2 is an enlarged sectional view showing a principal part of the component drier 11 shown in FIG. 1.

The component drier 11 comprises a housing 12, which provides a circulation path for hot air for drying components. A drying station 13 having a relatively large sectional area is formed in a part of the housing 12. This drying station 13 is provided with a rack 14, and a vat 15 is arranged on this rack 14. The vat 15 is used for receiving a plurality of components 16 to be dried, and at least its bottom wall 17 is adapted to allow passage of air. According to this embodiment, the bottom wall 17 is formed by a net. Such a bottom wall 17 of the vat 15 is arranged across the drying station 13.

In relation to the circulation path of the hot air, an air attracter 19 (a suction fan for example) having attraction of 25 m/sec., for example, is provided in order to forcibly circulate the air in the housing 12, as shown by arrows 18. A dehumidifier 20, a heater 21 and an air filter 22 are provided following the air attracter 19. A dehumidifying agent to be contained in the dehumidifier 20 is varied with the liquid, such as water or an organic solvent, adhering to the components 16. The air attracter 19, the humidifier 20, the heater 21 and the air filter 22 may be provided in any arbitrary order.

When such a component drier 11 is driven, the hot air is circulated as shown by the arrows 18. According to this embodiment, therefore, the hot air relatively passes through the plurality of components 16 and the bottom wall 17 of the vat 15 downwardly from above along arrows 23, as clearly shown in FIG. 2 in particular. At this time, the hot air is forced to move along the arrows 18 on the basis of attraction by the air attracter 19, thereby substantially evenly passing through all of the plurality of components 16 to be dried. Thus, it is possible to substantially evenly dry the overall components 16 in a short time.

Figure 3:
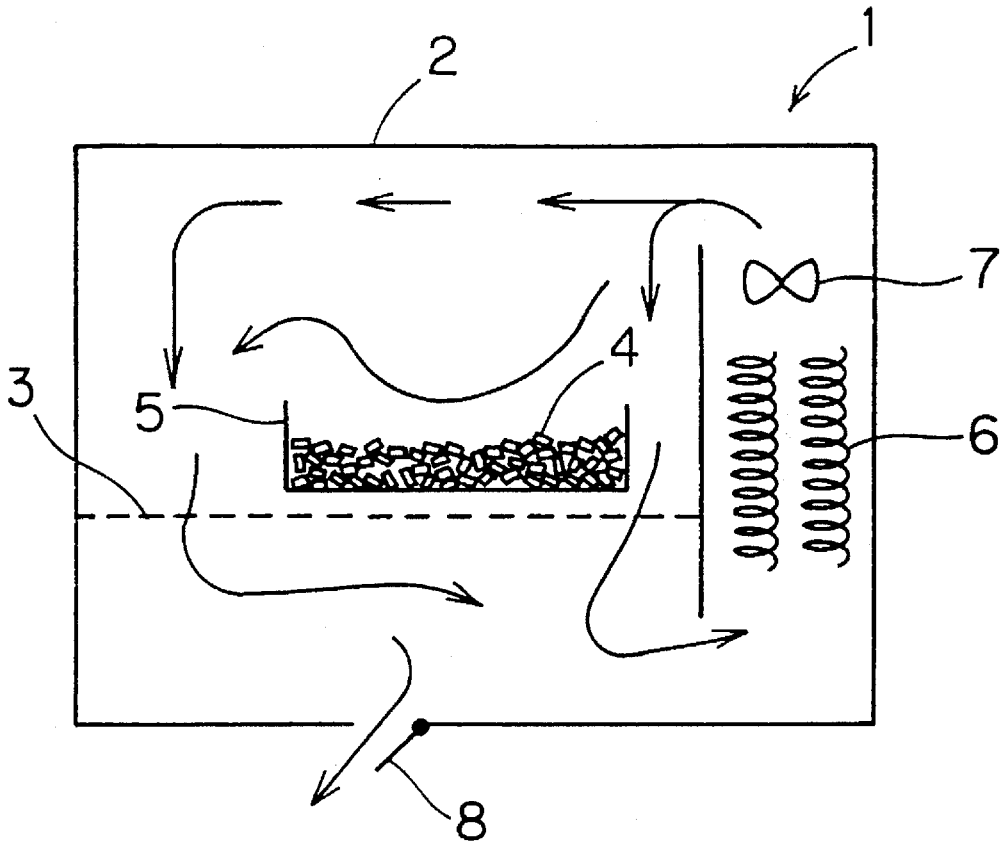
FIG. 3 PRIOR ART
FIG. 3 is an illustrative sectional view showing a conventional component drier 1.

In the conventional component drier 1 shown in FIG. 3, it took 70 minutes for drying 750 g of multilayer capacitors with hot air of 70° C., for example. In the inventive component drier 11 shown in FIG. 1, on the other hand, it was possible to dry the same amount of multilayer capacitors with hot air of 60° C. in two minutes.

According to this embodiment, the housing 12 is so closed as to recycle the hot air, whereby it is possible to reduce consumption of thermal energy.

Further, the components 16 to be dried are regularly supplied with clean hot air since the housing 12 is closed and provided with the air filter 22, while water or an organic solvent adhering to the components 16 can be forcibly removed by the hot air, which is forcibly circulated. Thus, it is possible to dry the components 16 so as to have a clean appearance with no spots resulting from drying. When the inventive component drier is employed for drying electronic components, therefore, it is also possible to improve the electric characteristics thereof.

Although the present invention has been described and illustrated in detail, it is clearly understood that the same is by way of illustration and example only and is not to be taken by way of limitation, the scope of the present invention being limited only by the terms of the appended claims.

What is claimed is:

1. A component drier comprising:

a drying station having a top, side walls and a cross sectional area;

a vat located in the drying station for receiving a plurality of components to be dried, at least a bottom wall of said vat having a plurality of apertures to allow passage of air therethrough, the vat bottom wall dividing the drying station into two regions and receiving the components to be dried thereon;

means for supplying recirculated hot air through an inlet in the top of said drying station to said vat for drying said components; and means for forcing all of the recirculated hot air supplied through said inlet downwardly through said inlet, through said plurality of components to be dried, and through said bottom wall of said vat by attraction of the recirculated hot air, said bottom wall of said vat having an area extending across the cross sectional area of said drying station, all of the recirculated hot air passing through said entire area of the bottom wall of said vat, there being no space for passage of air between the bottom wall of the vat and the side walls of the vat, said means for forcing said recirculated hot air being disposed in the circulation path of substantially all of the recirculated hot air and being spaced away from a downward path of material falling from said components in said drying station;

wherein the components to be dried are electronic components having electrodes on outer surfaces thereof;

said means for forcing said recirculated hot air comprise a housing closed to the external atmosphere for providing a closed-loop circulation path for the recirculated hot air and an air attractor arranged in said housing downstream from said vat, said vat being arranged in said housing.

2. A component drier in accordance with claim 1, wherein said bottom wall of said vat is formed by a net.

3. A component drier in accordance with claim 1, further comprising a dehumidifier and an air filter arranged in said housing for drying and filtering respectively, the recirculated hot air.

4. A component drier in accordance with claim 1, wherein said means for supplying hot air includes a heater arranged in said housing.

5. A component drier, comprising:

a housing for providing a closed-loop air circulation path, the housing being closed to the atmosphere;

a drying station located in said housing, said drying station having a top, side walls and a cross sectional area and including an inlet in said top;

a heater located in said housing for heating the air being circulated in said closed-loop air circulation path;

an air attractor positioned in said housing for forcing the heated air around said circulation path and downwardly through said inlet; and a vat disposed in said drying station for receiving a plurality of components to be dried, said vat including a bottom wall having a plurality of apertures to allow passage of the heated air therethrough, the vat bottom wall dividing the drying station into two regions and receiving the components to be dried thereon, said bottom wall having an area extending across the cross sectional area of said drying station in said circulation path, all of the hot air being supplied through said inlet passing downwardly from said inlet through the entire area of said bottom wall and through the components, there being no space for passage of air between the bottom wall of the vat and the side walls of the vat, said heater and said air attractor being disposed in said circulation path of the heated air and said air attractor being spaced away from a downward path of material falling from said components in said drying station;

and further wherein said components to be dried are electronic components having electrodes on outer surfaces thereof.

* * * * *